US005909803A

United States Patent [19]

Clark

[11] Patent Number: 5,909,803

[45] Date of Patent: Jun. 8, 1999

[54] REPAIR KIT FOR ADJUSTABLE HEADGEAR

[75] Inventor: Robert Burton Clark, Austin, Tex.

[73] Assignee: Eonic Creations, Inc., Austin, Tex.

[21] Appl. No.: 08/804,135

[22] Filed: Feb. 20, 1997

[51] Int. Cl.[6] ..... A42B 1/22

[52] U.S. Cl. ..... 2/195.2

[58] Field of Search ..... 2/195.2, 195.3, 2/195.4; 24/3.11, 3.13, 17 B, 30.5 P

[56] References Cited

U.S. PATENT DOCUMENTS

| | | | |
|---|---|---|---|
| Re. 15,815 | 4/1924 | Trau | 2/195.2 |
| 1,738,905 | 12/1929 | Kiefer | 2/195.2 |
| 5,652,959 | 8/1997 | Proctor | 2/195.2 |
| 5,657,491 | 8/1997 | Young | 2/195.2 |
| 5,771,493 | 6/1998 | Proctor | 2/195.2 |

*Primary Examiner*—Diana L. Oleksa
*Attorney, Agent, or Firm*—Jenkens & Gilchrist

[57] ABSTRACT

A repair kit for adjustable size headgear includes one or more replacement elements, each replacement element having matching attachment means, each replacement element also having a fastener for attachment to the hat with which the adjustable size mechanism is used, the fastener including means for surrounding a portion of a broken element of the adjustable sized hat so as to provide a connection to the hat having sufficient strength in tension to prevent the replacement element from separating from the hat.

15 Claims, 5 Drawing Sheets

REPAIR KIT FOR ADJUSTABLE HEADGEAR

BACKGROUND OF THE INVENTION

1. Field of the Invention

The present invention relates to headgear, and more particularly to a repair kit for repairing adjustable elements on headgear.

2. Prior Art

In the prior art, there has been no adequate technique for repairing adjustable straps on headgear. For example, on currently popular baseball style caps which have straps at the back of the cap which may be joined together at any of a number of links to fit a user's head, the hat generally becomes useless if one of the adjustable strap members breaks or becomes damaged.

Some prior art attempts at solving the problem involved mechanical fasteners similar to paper staples, adhesive tape or chemical adhesives A disadvantage of prior art attempts at solving the problem of broken or damaged straps for adjustable headgear is that these approaches are neither reliable nor aesthetic and are generally not adopted by the hat wearing public.

Accordingly, there is a need for a reliable mechanism for repairing straps on adjustable headgear that is reliable and would be accepted by the consuming public.

SUMMARY OF THE INVENTION

Accordingly, a repair kit for adjustable size headgear includes one or more replacement elements, such as first and second replacement elements having matching attachment means, the first and second replacement elements each having a fixture for attachment to the headgear, the fixture including means for surrounding or engaging a portion of a damaged element of the adjustable sized headgear so as to provide a connection to the headgear having sufficient strength to prevent the first or second elements from separating from the headgear, the attachment means adapted for attachment to a complementary attachment mechanism of a headgear element, and the replacement element having a fixture for secure engagement with a damaged headgear element.

The attachment mechanism may be in the form of any attachment mechanism conventionally used for removably and/or adjustably attaching headgear elements together or in the form of any suitable attachment mechanism.

Thus, for example, the attachment mechanism may be in the form of one or more complementary studs or nubs to engage with one or more complementary holes defined in another headgear element, in the form of one or more holes to be engaged by one or more complementary studs or nubs provided on another headgear element, in the form of a VELCRO type material or other fabric attachment means for engagement with a complementary VELCRO type material or other fabric attachment means of another headgear element, in the form of a compression clip for engagement with a complementary headgear element, or may be any other suitable engagement mechanism.

The fixture of the replacement element may be any suitable fixture which can be securely engaged to a damaged or broken headgear element.

Thus, for example, the fixture may comprise a friction clamp, a compression clamp, complementary friction rivets or studs or over-center locking clip or clamp, an adhesive, a sealed adhesive pod which is activated by exposure to heat or air, or any other suitable fixture for securely fixing the replacement element to a broken or damaged headgear element.

It is an advantage of the present invention that a repair kit for an adjustable hat may be constructed inexpensively and may increase the life of headgear which had adjustment elements broken or damaged during wear.

DETAILED DESCRIPTION OF A PREFERRED EMBODIMENT OF THE INVENTION

Figure 1A:
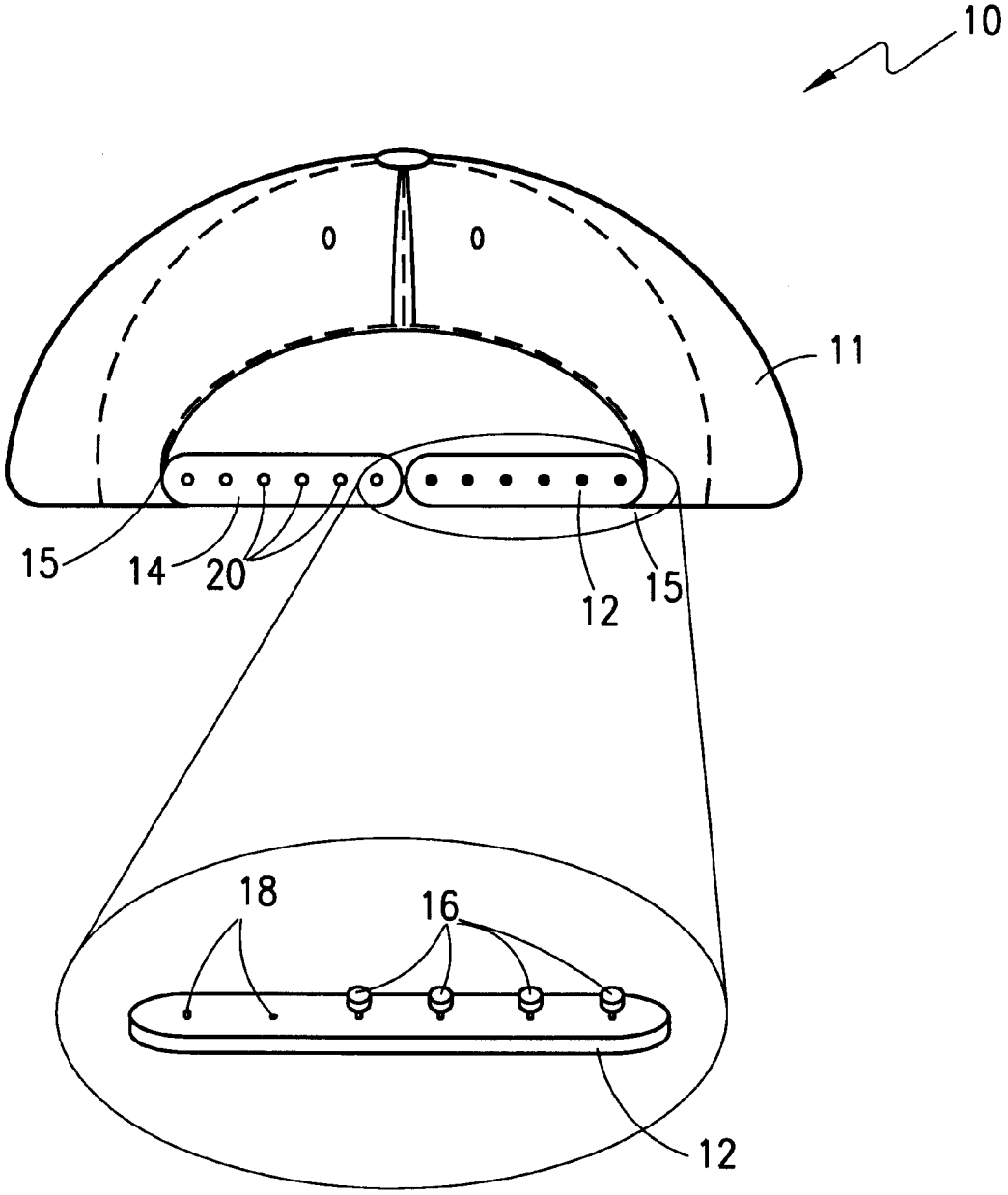
FIG. 1A is a perspective drawing of a cap having an adjustable male strap thereof damaged so as to render the cap useless.

Referring now to FIG. 1A, a baseball style cap 10 is shown in a rear view in which the male adjustment strap 12 has been broken and thus rendered useless whereas the female attachment matching strap 14 is intact. It should be noted that the adjustment straps 12 and 14 are attached to the body 11 of cap 10 by attachment means 15 which might be for example by sewing with high strength thread. In the blowup portion of FIG. 1A, the broken male strap 12 is shown as having a series of spaced nubs 16 which are adapted to mate with holes 20 in female strap 14. The two leftmost nubs at positions 18 are shown as having the nubs broken off which renders cap 10 useless.

Figure 1B:
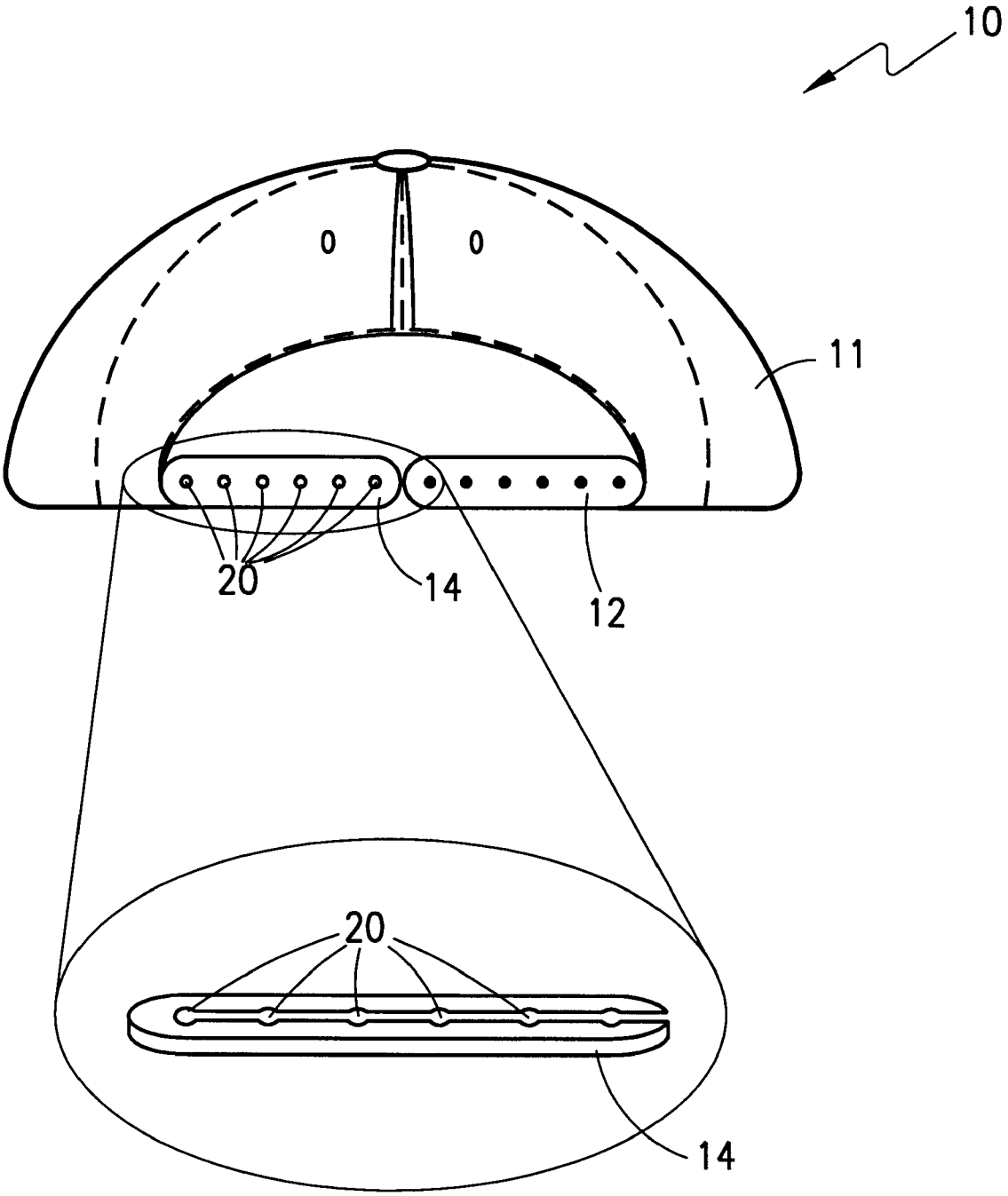
FIG. 1B is a perspective drawing of a cap having an adjustable female strap thereof damaged so as to render the cap useless.

Referring now to FIG. 1B, the baseball style cap 10 is shown in a rear view in which the female adjustment strap 14 has been broken and thus rendered useless. In the blowup portion of FIG. 1B, the broken female strap 14 is shown as having a series of spaced holes 20 which are adapted to mate with nubs 16 in male strap 12. There is shown a longitudinal split in the material of female strap 14 which renders the cap 10 useless.

Figure 2:
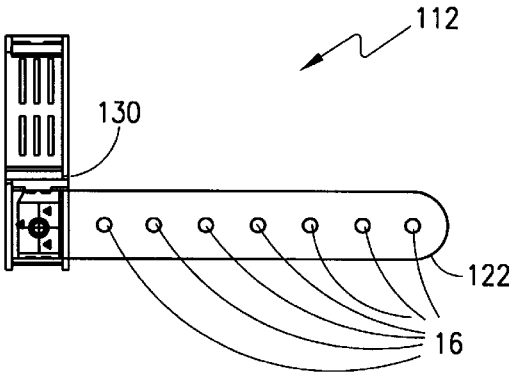
FIG. 2 is a top plane view of a male replacement strap in accordance with the present invention.
Figure 3:
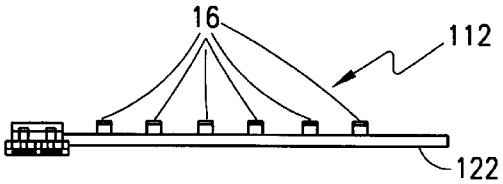
FIG. 3 is a side section view of the male replacement strap of FIG. 2 in accordance with the present invention.

Referring now to FIGS. 2 and 3, a male replacement strap with attachment fixture according to the present invention will be described.

FIG. 2 shows a top plane view and FIG. 3 is a side section view of a male attachment strap 112 according to the present invention. Male attachment strap 112 comprises an elongated member 122 which may typically be constructed of plastic. The elongated member 122 has a series of attachment members (nubs)16 of the type common to attachment straps generally used with adjustable caps.

The male attachment strap 112 according to the present invention also has at one end thereof a fastener 130 having a plurality of teeth 132 (see FIGS. 7 and 8) for joining the male replacement strap 112 to a portion of an original broken attachment strap 12. (See FIG. 1A). Teeth 132 may be set at an appropriate angle such as 30 degrees to improve the strength of the attachment when placed in tension.

Figure 4:
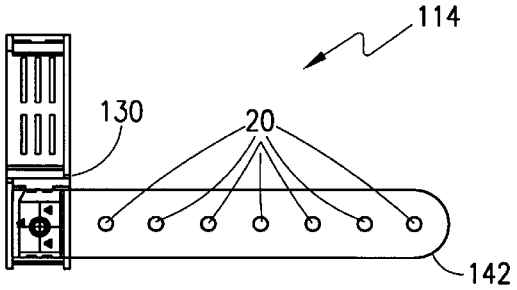
FIG. 4 is a top plane view of a female replacement strap in accordance with the present invention.
Figure 5:
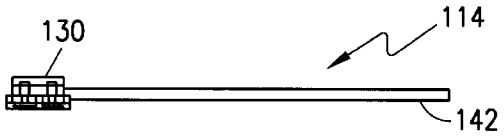
FIG. 5 is a side section view of the female replacement strap of FIG. 4 in accordance with the present invention.

Referring now to FIGS. 4 and 5, a female replacement strap 114 in accordance with the present invention will be described. Female replacement strap 114 has an elongated member 142 similar to the male replacement strap 112. However, female replacement strap 114 has a series of holes adapted to accept the attachment members 16 of male strap into holes 20 with a snug friction fit.

Female replacement strap 114 also includes a fastener 130 which is similar in construction to the fastener on male replacement strap 112.

Figure 6:
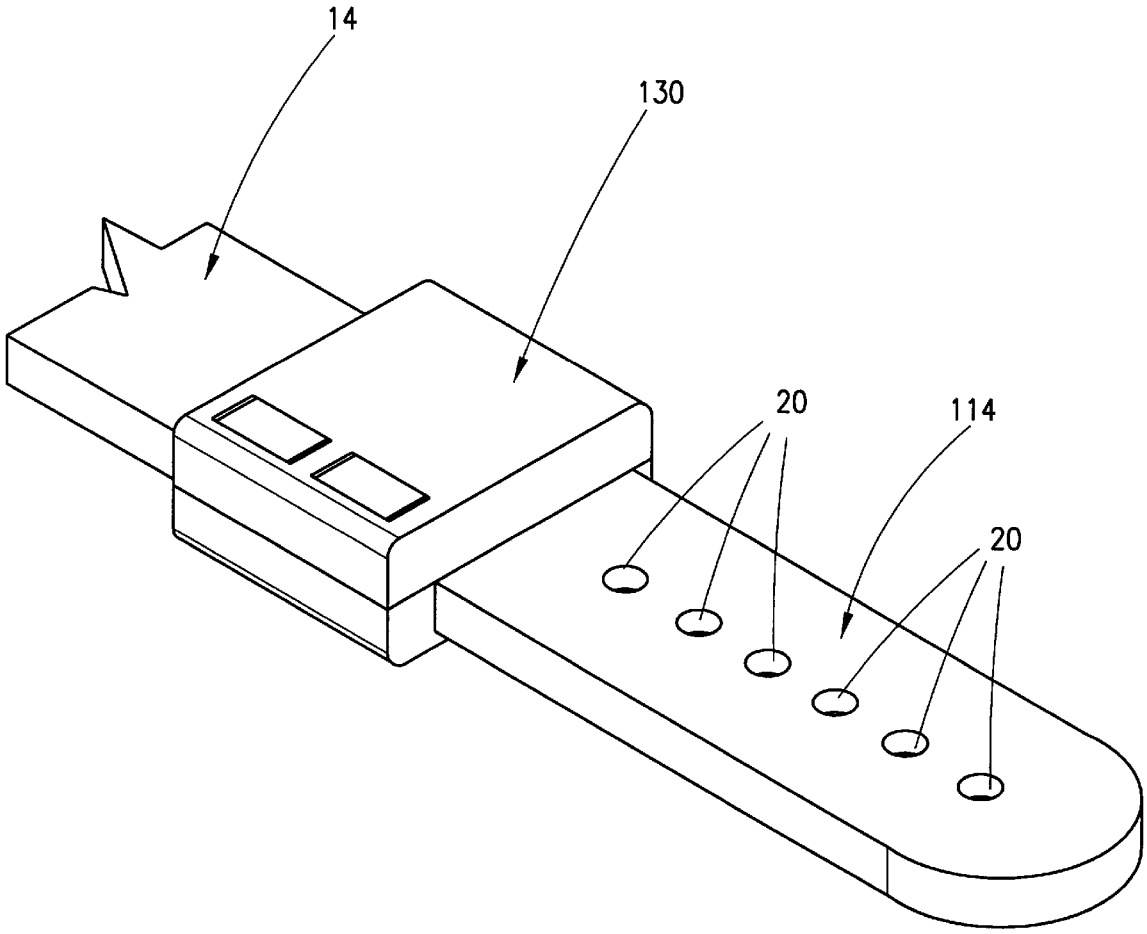
FIG. 6 is a diagram showing attachment of the replacement straps of either FIG. 2 or FIG. 4 to a remaining portion of an original strap on the cap.

Referring now to FIG. 6, the attachment of a female replacement strap 114 to a damaged original female strap 14 on cap 10 will be described.

Original female strap 14 is cut to a length which allows the replacement strap 114 to be attached and which allows holes 20 on replacement strap 114 to align with nubs 16 on male strap 12 while providing a range of sizes suitable for a corresponding range of human head sizes. Fastener 130, which is described in more detail with reference to FIGS. 7 and 8, is then closed over the junction between original strap 14 and replacement strap 114 to complete the attachment of the replacement strap to a damaged original strap.

Although the replacement of a broken strap has been described with reference to a female strap, it is understood that the replacement of a broken male strap would be substantially the same as described for the female strap.

Figure 7:
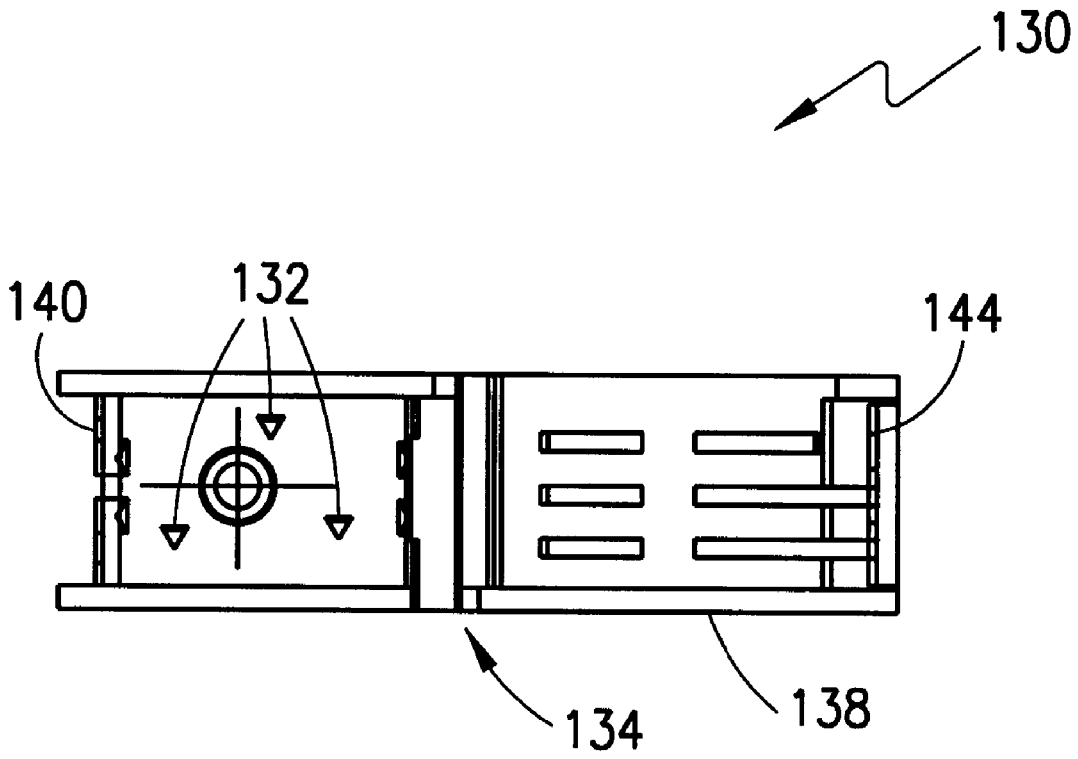
FIG. 7 is a top plane view of a fastener in an open position for attaching a replacement strap to an original strap of a cap in accordance with the present invention.
Figure 8:
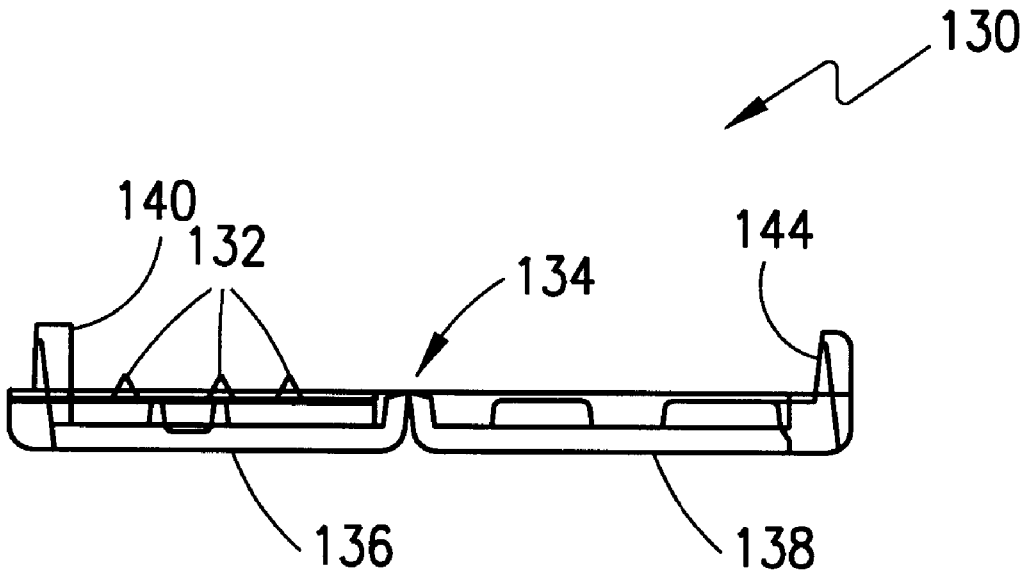
FIG. 8 is a side section view of a fastener in an open position for attaching a replacement strap to an original strap of a cap in accordance with the present invention.

Referring now to FIGS. 7 and 8, a fastener for attaching a replacement strap (either male or female) to a damaged original strap on a cap 10 will be described.

Fastener 130 may be constructed of a plastic material with hinges 134 in the plastic material to allow fastener 130 to be easily folded over the protruding portion of broken strap 12 such that the teeth 132 will engage broken strap 12, 14 to provide a secure attachment between the replacement strap 112, 114 and the broken strap 12, 14.

To lock fastener 130, top portion 138 is folded over the original strap portion 12, 14 and locked securely in place to bottom portion 136 with snap lock female member 142 in top portion 138 engaging snap lock male member 140 in bottom portion 136.

Although fastener 130 is described with respect to the use of teeth 132 to engage the original straps 12, 14 rivets, other friction devices or adhesives may be employed to provide sufficient strength in tension for attachment of the replacement straps 112, 114 to original straps 12 and 14.

With fastener 130 folded over and securely attached, cap 10 may be used and the size may be adjusted as appropriate for a user.

While the preferred embodiment illustrated in the drawings employs teeth to engage the original strap or headgear element, the present invention could alternatively also employ sharpened teeth or spikes which can penetrate or pierce such a damaged or broken original strap or headgear element. In this embodiment, the teeth or spikes may be provided on either the top or the bottom portion, or both, and complementary bores or recesses may be provided in the opposing portion for receiving the teeth or spikes when the top and bottom portions have been engaged with each other.

While the replacement elements attachment mechanisms and fixtures are preferably made of a synthetic plastic material, they may also be made of or include other suitable materials. For example, the replacement elements may be made of woven material, while the attachment mechanisms and fixtures may be made of or may include, where appropriate, metal portions or components.

Although the present invention and its advantages have been described in detail, it should be understood that various changes, substitutions and alterations can be made herein without departing from the spirit or scope of the invention as defined in the appended claims.

What is claimed is:

1. A repair kit for repairing size-adjustable headgear, comprising:

at least one replacement element, each replacement element comprising a fastener and a series of means for attaching the replacement element to a mating element attached to the headgear to provide a variable length of attachment suitable to a user, the fastener including means for frictionally engaging a portion of a strap to be replaced, and means for attaching the replacement element to the portion of the strap to be replaced.

2. A repair kit according to claim 1 wherein the frictional engaging means are a plurality of teeth embedded in the fastener to provide a secure attachment between the replacement element and an element being replaced.

3. A repair kit according to claim 2 wherein the teeth are metal teeth set at a predetermined angle to a major axis of the at least one replacement element.

4. A repair kit according to claim 1 wherein the frictional engaging means is a rivet.

5. A repair kit according to claim 1 wherein the at least one replacement element is constructed of a plastic material.

6. A method for repairing headgear having adjustable elements for fitting a plurality of sizes, wherein one or more of the adjustable elements is defective, comprising the steps of:

cutting the defective element to a predetermined length;

aligning a replacement element with the predetermined length of the defective element;

fastening the replacement element to the defective element with a fastener which frictionally engages the defective element; and locking the fastener in frictional attachment to the defective element to provide a secure attachment.

7. A method according to claim 6 wherein the fastening step employs as a frictional engaging means, a plurality of teeth embedded in the fastener to provide a secure attachment between the replacement element and the defective element.

8. A method according to claim 6 wherein the fastening step employs as a frictional engaging means, one or more rivets embedded in the fastener to provide a secure attachment between the replacement element and the defective element.

9. A method according to claim 6 wherein the fastening step employs an element with a fastener which engages the defective element by an adhesive means.

10. A replacement kit, for replacing an existing headgear element of an adjustable size headgear, the replacement kit comprising:

at least one replacement element and means for securely engaging the replacement element to an existing headgear element, wherein the means for securely engaging comprising a friction clamp.

11. A replacement kit according to claim 10 in which the friction clamp includes teeth to engage with and penetrate the existing headgear element.

12. A replacement kit according to claim 11 in which the friction clamp includes two complementary members to be locked to each other over the existing headgear element.

13. A replacement kit according to claim 10 which comprises a pair of complementary replacement elements, the complementary replacement elements having complementary attachment mechanisms for attachment to each other and each element having means for securely engaging the replacement element to an existing headgear element, wherein the means for securely engaging comprises a friction clamp.

14. A replacement kit, for replacing an existing headgear element of an adjustable size headgear, the replacement kit comprising:

at least one replacement element and means for securely engaging the replacement element to an existing headgear element, wherein the means for securely engaging comprises an adhesive means.

15. A replacement kit according to claim 14 which comprises a pair of complementary replacement elements, the complementary replacement elements having complementary attachment mechanisms for attachment to each other and each element having means for securely engaging the replacement element to an existing headgear element, wherein the means for securely engaging comprises an adhesive means.

* * * * *